United States Patent [19]

Sugiyama

[11] 4,226,019

[45] Oct. 7, 1980

[54] CLEANING MEMBER FOR TWO-EDGE SHAVING BLADE UNIT

[75] Inventor: Makoto Sugiyama, Seki, Japan

[73] Assignee: KAI Cutlery Center Co., Ltd., Gifu, Japan

[21] Appl. No.: 6,872

[22] Filed: Jan. 26, 1979

[30] Foreign Application Priority Data

Jan. 27, 1978 [JP] Japan ..... 53-7829

[51] Int. Cl.[3] ..... B26B 21/22

[52] U.S. Cl. ..... 30/41

[58] Field of Search ..... 30/41

[56] References Cited

U.S. PATENT DOCUMENTS 4,047,296 9/1977 Ishida et al. ..... 30/41

*Primary Examiner*—Jimmy C. Peters

*Attorney, Agent, or Firm*—Norbert P. Holler; Charles A. Blank

[57] ABSTRACT

The ejecting member is interposed between two blade elements of a two-edge shaving blade unit in a manner to be retractably moved forwardly to eject shaved hair particles and other matters deposited in and clogging the space between the cutting edges of two blade elements. The ejecting member has an integral construction which includes an outer frame portion defining the outer profile of the ejecting member, a substantially quadrilateral aperture having at least one discontinuity and defining at its outer sides the inner edges of the outer frame portion, an inner island portion fixedly cramped between two blade elements and defined by the inner sides of the aperture, and a resilient bridge portion constituted by the discontinuity of the aperture and resiliently connecting the inner island portion to the outer frame portion. The outer frame portion may be moved resiliently to eject the shaved hair particles or the like, when it is pressed forwardly while the inner island portion is unmovably cramped between the blade elements, thanks to the resiliency of the resilient bridge portion.

10 Claims, 7 Drawing Figures

CLEANING MEMBER FOR TWO-EDGE SHAVING BLADE UNIT

BACKGROUND OF THE INVENTION

The present invention relates to a cleaning member for a two-edge shaving blade unit and, more particularly, to an improvement in the construction of a member interposed between two blade elements for ejecting as required the shaved hair particles and other matters deposited in and clogging the space between the leading and following cutting edges.

It is known that a two-edge safety razor can provide preferable shaving characteristics. Such razor includes therein two blade elements disposed parallel to each other in spaced relation to provide leading and following cutting edges so that both cutting edges are successively active with respect to the hair elements being cut during a single shaving stroke.

During shaving with the use of the two-edge safety razor, the hair particles and other matter produced are gradually deposited in and thus clog the space between the leading and following cutting edges of the two-edge shaving blade unit. Such deposited matter makes the shaving characteristics of the razor inferior, so that it must be removed at a suitable stage during, before and/or after shaving.

In order to overcome this problem, there have been proposed various two-edge shaving blade units having means for ejecting the shaved hair particles and other matters deposited in and clogging the space between two cutting edges.

For instance, the specification of U.S. Pat. No. 4,047,296 discloses a two-edge shaving blade unit including a cap member having a laterally elongated slot formed at its rear portion to provide a resilient thin rear wall. The resilient rear wall is connected to a rearward projection of an ejecting member which is interposed between two blade elements and movable back and forth in sliding contact with these blades elements. The resilient rear wall of the cap member exerts such a resilient force on the ejecting member as to normally keep the latter in the retracted position. For ejecting the shaved hair particles and other matters clogging the space between the cutting edges of two blade elements, the resilient rear wall is pressed forwardly, overcoming the resilient force of the rear wall, so as to move the ejecting member forwardly, thereby to eject the shaved hair particles and other matters.

This type of blade unit, however, involves various problems. Namely, the kinds of material of the cap member is inconveniently limited, because the cap member has to have a sufficient resiliency. At the same time, the construction is impractically complicated and the assembling is difficult and time consuming because it is necessary to mechanically connect the resilient rear wall of the cap member to the rearward projection of the ejecting member. Thus, the cost of production of the safety razor is raised uneconomically.

Meanwhile, Japanese Utility Model Publication No. 32787/1978 discloses a two-edge shaving blade unit, in which a coiled springs are disposed to act between a downward rear bend of the ejecting member and the razor body, so as to resiliently bias the ejecting member to the retracted position. The mounting of such tiny parts as coiled springs in a small assembly such as a safety razor, however, is extremely troublesome and time consuming, and incurs a rise of cost of manufacture of the safety razor.

SUMMARY OF THE INVENTION

It is therefore a primary object of the invention to provide an improved ejecting member for use in a two-edge shaving blade unit which is capable of promptly and easily ejecting the shaved hair particles and other matters deposited.

It is another object of the invention to provide an improved ejecting member which does neither necessitate the use of a resilient cap member, nor the use of the coiled springs as used in the prior art units, thereby to eliminate the inconveniences caused in the prior art units.

To these ends, there is provided in accordance with the invention an improved ejecting member adapted to be interposed between two blade elements of a two-edge shaving blade unit and to be retractably slided forwardly to eject shaved hair particles and other matters deposited in and clogging the space between the cutting edges of two blade elements, which comprises a tabular construction including an outer frame portion, an inner island portion surrounded by the outer frame portion and separated from the latter by an aperture, the inner island portion being adapted to be fixed to the blade elements of the two-edge shaving blade unit, and means for allowing the outer frame portion to be resiliently moved relatively to the inner island portion.

In a preferred form of the invention, the ejecting member has an integral tabular construction including an outer frame portion which defines the outer profile of the ejecting member, a substantially quadrilateral aperture having at least one discontinuity and defining at its outer sides the inner peripheral edges of the outer frame portion, an inner island portion defined by the inner sides of the substantially quadrilateral aperture and adapted to be fixed to the blade members of the two-edge shaving unit, and at least one resilient bridge portion constituted by the discontinuity of the substantially quadrilateral aperture and resiliently connecting the inner island portion to the outer frame portion, wherein the outer frame portion and the resilient bridge portion have a thickness smaller than that of the inner island portion.

Preferably, the ejecting member is fabricated from a resilient sheet material by punching.

BRIEF DESCRIPTION OF THE DRAWINGS

These and other objects, as well as advantageous features of the invention will become more apparent and more readily understandable by the following description and the appended claims when read in conjunction with the accompanying drawings in which:

DESCRIPTION OF THE PREFERRED EMBODIMENTS

Figure 1A:
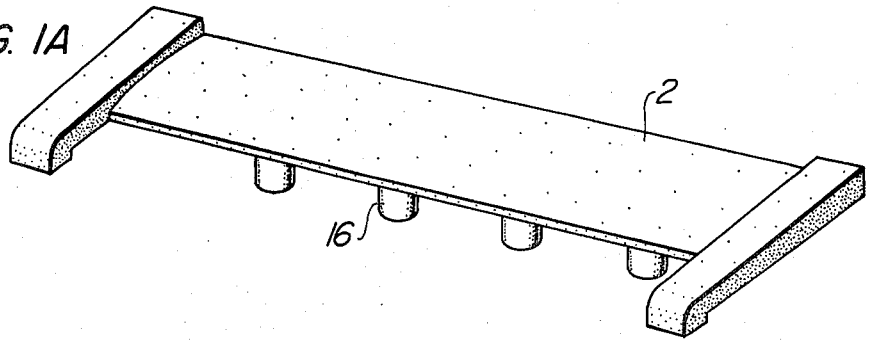
FIG. 1A is a perspective view of a cap member of a safety razor in which a two-edge shaving blade unit having an ejecting member of the invention is used.
Figure 1B:
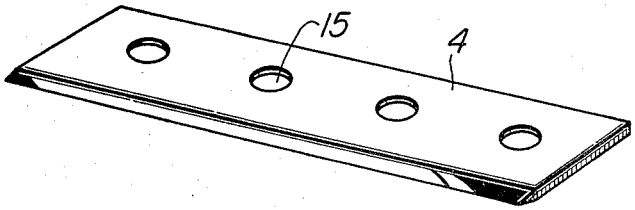
FIG. 1B is a perspective view of an upper blade element of the two-edge shaving blade unit.
Figure 1C:
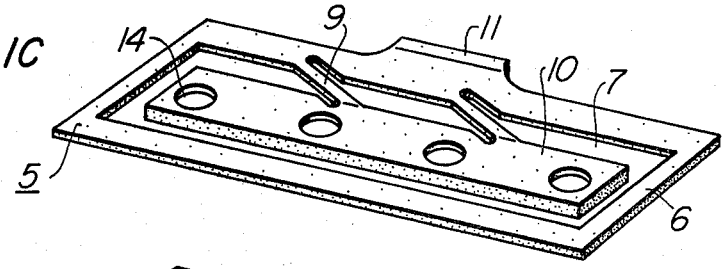
FIG. 1C is a perspective view of an ejecting member embodying the present invention.
Figure 1D:
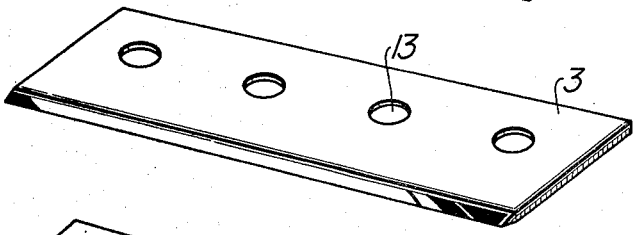
FIG. 1D is a perspective view of a lower blade element of the two-edge shaving blade unit.
Figure 1E:
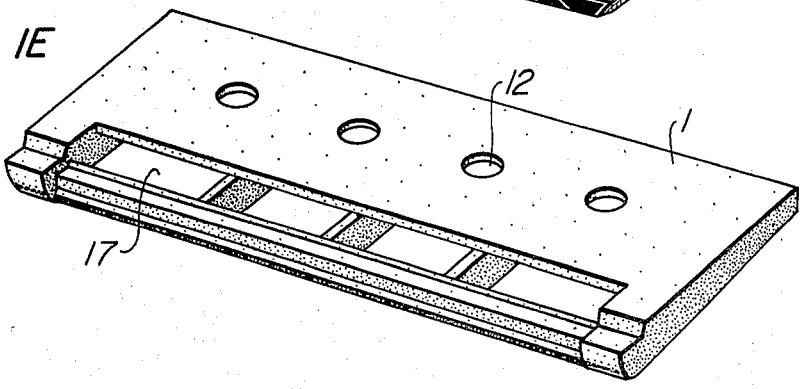
FIG. 1E is a perspective view of a platform member of the razor.

Referring to the drawings, particularly to FIG. 1C, an ejecting member embodying the invention is generally designated at a reference numeral 5. The ejecting member 5 has an integral tabular construction including an outer frame portion 6, an inner island portion 10 separated from the outer frame portion 6 by an aperture 7 and adapted to be fixed to the later-mentioned blade elements, and resilient bridge portions 9, 9 which connect the inner island portion 10 to the outer frame portion 6 in a manner to allow the outer frame portion 6 to resiliently move relative to the inner island portion.

More specifically, the ejecting member 5 as a whole has a generally rectangular outer profile defined by the outer edges of the outer frame portion 6. The aperture 7 is substantially quadrilateral and has two discontinuities which constitute the resilient bridge portions 9, 9. The outer sides of the substantially quadrilateral aperture 7 define the inner edges of the outer frame portion 6, while the inner sides of the same define the outer edges of the inner island portion 10. Thus, the inner island portion 10 is connected to the outer frame portion 6, by the resilient bridges 9, 9 in a manner to allow the outer frame portion 6 to move resiliently and retractably, relative to the inner island portion. The outer frame portion 6 and the resilient bridge portions 9, 9 have a thickness smaller than that of the inner island portion 10. The inner island portion 10 has through bores 14 for receiving later-mentioned downward projections 16 of a cap member 2.

The razor head of the razor in which the two-edge shaving blade unit of the invention having the ejecting member of the invention is mounted has, as will be most clearly seen from FIGS. 1A to 1E, the cap member 2 having the downward projections 16, an upper blade element 4 having through bores 15 for receiving the downward projections 16 of the cap member 2 and adapted to overlie the ejecting member 5, the ejecting member 5, a lower blade element 3 having through bores 13 for receiving the downward projections 16 of the cap member 2 and adapted to underlie the ejecting member 5, and a platform member 1 also having through bores 12 for receiving the downward projection 16 of the cap member 2.

Figure 2:
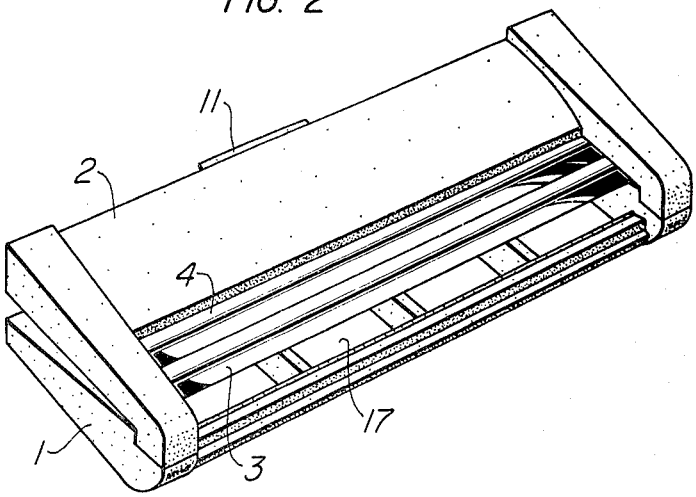
FIG. 2 is a perspective view of a razor head in the state for use.

In assembling, the platform member 1, lower blade element 3, ejecting member 5 and the upper blade element 4 are superposed in the mentioned order, such that the through bores 12, 13, 14 and 15 are vertically aligned. Then, the cap member 2 is placed on the upper blade element 4, with its downward projections 16 inserted into the vertically aligned through bores 15, 14, 13 and 12. The ends 16′ of the downward projections exposed to the lower side of the platform member 1 is welded to the lower surface of the platform member 1, so as to complete the razor head as shown in FIGS. 2 and 3.

Figure 3:
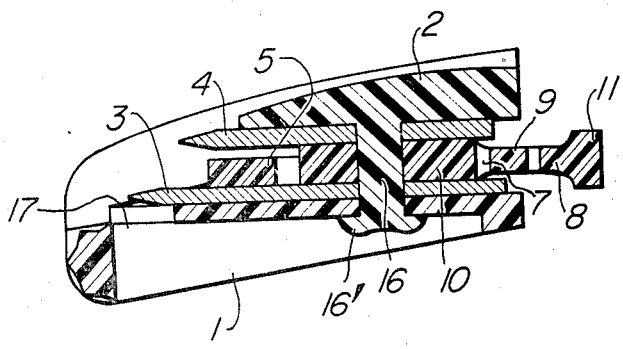
FIG. 3 is a cross-sectional view of the razor head as shown in FIG. 2.

As will be seen from FIG. 3, in the assembled razor head, the front edge of the outer frame portion 6 of the ejecting member 5 is positioned behind the cutting edges of both blade members 3, 4. At the same time, since the thickness of the outer frame portion 6 and the resilient bridge portions 9, 9 is smaller than that of the inner island portion 10, the ejecting member 5 is cramped between the upper and lower blade elements 4, 3 only at its inner island portion 10, while the outer frame portion 6 is allowed to move retractably in the space between two blade elements as the resilient bridge portions 9, 9 are deflected resiliently in response to a depressing force exerted on the rear edge of the ejecting member 5. In order to facilitate the depression of the ejecting member 5, the rear wall 8 of the outer frame portion 6 of the ejecting member 5 is preferably provided with a knob 11 extending rearwardly therefrom beyond the rear edges of the cap member 2 and the platform member 1.

For ejecting the shaved hair particles and other matters deposited in and clogging the space between the cutting edges, the ejecting member 5 is pressed at its knob 11 forwardly by a finger retained on the knob 11. Consequently, the resilient bridge portions 9, 9 are resiliently deflected to allow the outer frame portion 6 to move forwardly, until the front edge of the outer frame portion 6 is revealed to forcibly eject the shaved hair particles and other matters out of the space between the cutting edges of the blade members. The ejected matters are dropped through apertures 14 formed in the front portion of the platform member 1. Then, as the knob 11 is relieved from the manual pressing force, the outer frame portion 6 is retracted by the resilient force exerted by the resilient bridge portions 9, 9, until the front edge thereof is again hidden behind the cutting edges of the blade elements. The ejecting member 5 may be simply produced from a resilient blank by a punching.

The ejecting member of the invention having described construction and operation offers the following advantages over the prior art. Namely, since the cap member itself is not required to make a resilient deformation, the material of the cap member can have wider selection, and it becomes possible to form the cap member even with a rigid material. At the same time, the troublesome work necessitated in the prior art blade unit for mechanically connecting the rear end of the cap member to the rear portion of the ejecting member is conveniently eliminated. In addition, since the ejecting member itself can exert a resilient force, it is not necessary to install coiled springs for resiliently biasing the ejecting member. Moreover, the ejecting member of the invention can be produced at a remarkably lowered cost of production, simply by a punching from a resilient blank sheet. Further, since the use of coiled springs nor the mechanical connection between the rear ends of the cap member and the ejecting member are not essential, the upper blade element, ejecting member and the lower blade elements can conveniently be produced and sold as a renewable unit.

Having described the invention through its preferred form, it is to be noted that the description has been made solely by way of example, and not in limiting sense.

For instance, the fixing of the upper blade element, ejecting member, lower blade element and the platform member can be achieved by other means than the welding of the lower ends 16′ of the projection 16 to the lower surface of the platform member 1.

Clearly, various changes and modifications may be imparted to the described embodiment, without departing from the spirit and scope of the invention which are limited solely by the appended claims.

I claim:

1. An ejecting member adapted to be interposed between two blade elements of a two-edge shaving blade unit and to be retractably moved forwardly to eject shaved hair particles and other matters deposited in and clogging the space between the cutting edges of said blade elements, the improvement wherein said ejecting member has an integral tabular construction including an outer frame portion which defines the outer profile of said ejecting member, an aperture which defines at its outer sides the inner edges of said outer frame portion, an inner island portion defined by the inner sides of said aperture and adapted to be fixedly cramped between said upper and lower blade elements, and at least one resilient bridge portion by which said inner island portion is resiliently connected to said outer frame portion, wherein said outer frame portion and said resilient bridge portion are thinner than said inner island portion.

2. An ejecting member as claimed in claim 1, wherein said outer frame portion has a substantially rectangular form, while said aperture has a generally quadrilateral shape.

3. An ejecting member as claimed in claim 1 or 2, wherein said aperture has at least one discontinuity which constitutes said resilient bridge portion.

4. An ejecting member as claimed in claim 1 or 2, wherein the number of said resilient bridge portion is two.

5. An ejecting member as claimed in claim 1, wherein said outer frame portion is provided at its rear end with a knob on which a manual force for pressing said ejecting member forwardly is exerted.

6. A two-edge shaving blade unit comprising an ejecting member interposed between two blade elements of said blade unit to be retractably moved forwardly to eject shaved hair particles and other matters deposited in and clogging the space between the cutting edges of said blade elements, the improvement wherein said ejecting member has an integral tabular construction including an outer frame portion which defines the outer profile of said ejecting member, an aperture which defines at its outer sides the inner edges of said outer frame portion, an inner island portion defined by the inner sides of said aperture and adapted to be fixedly cramped between said upper and lower blade elements, and at least one resilient bridge portion by which said inner island portion is resiliently connected to said outer frame portion, wherein said outer frame portion and said resilient bridge portion are thinner than said inner island portion.

7. A two-edge shaving blade unit as claimed in claim 6, wherein said outer frame portion has a substantially rectangular form, while said aperture has a generally quadrilateral shape.

8. A two-edge shaving blade unit as claimed in claim 6, or 7, wherein said aperture has at least one discontinuity which constitutes said resilient bridge portion.

9. A two-edge shaving blade unit, as claimed in claim 6 or 7, wherein the number of said resilient bridge portion is two.

10. A two-edge shaving blade unit, as claimed in claim 6, wherein said outer frame portion is provided at its rear end with a knob on which a manual force for pressing said ejecting member forwardly is exerted.

* * * * *